United States Patent [19]

Brewer

[11] 3,946,925

[45] Mar. 30, 1976

[54] RIVETTING MACHINES

[76] Inventor: Clifford Edmund Brewer, "Lucky Stars", Lagoon Road, Lilliput, Parkstone, Dorset, England

[22] Filed: Nov. 26, 1974

[21] Appl. No.: 527,344

[30] Foreign Application Priority Data

Nov. 26, 1973 United Kingdom ..... 54822/73

[52] U.S. Cl. ..... 227/60; 227/55

[51] Int. Cl.² ..... B21J 15/10

[58] Field of Search ..... 227/60, 61, 62

[56] References Cited

UNITED STATES PATENTS

| | | | |
|---|---|---|---|
| 602,881 | 4/1898 | Smith | 227/55 |
| 2,257,379 | 9/1941 | Havener | 227/61 |
| 3,495,754 | 2/1970 | Henshaw | 227/60 |

*Primary Examiner*—Granville Y. Custer, Jr.
*Attorney, Agent, or Firm*—Morris Liss

[57] ABSTRACT

A tubular rivet is picked up by a rivet engaging pin supported on a support which is releasably coupled to means for urging the pin into a position in which it can engage with a rivet. Control means allow the urging means to move the pin into the position at a first station. The rivet is moved to a second station at which a force bypassing the pin is applied to the support to break the coupling to cause the pin to move to an inoperative position to avoid permanent deformation of the pin. The control means causes the reconnection of the coupling as the pin is moved from the second station to the first station.

24 Claims, 17 Drawing Figures

125
200

D
E
A
10
201
41
42
23
12
3
31
22
29
21
20
126
2
28
120
33
32
34
56
54
122a
122b
202
1

RIVETTING MACHINES

BACKGROUND OF THE INVENTION

1. Field of the Invention

The invention relates to a riveting apparatus and more particularly to an apparatus arranged to feed tubular rivets, automatically, to a workpiece riveting station.

By the term "tubular rivet" is meant herein a rivet having a tubular portion open at both ends and having a flange at one end of the portion, but no mandrel.

2. Description of the Prior Art

In a known riveting apparatus described in U.S. Pat. No. 3,495,754 a rotary carrier carries a plurality of rivet engaging pins. The pins are radially displaceable, being biased outwards pneumatically. The carrier rotates and the rivet engaging pins engage with respective tubular rivets at a raceway and convey them one at a time to an angular position of the carrier at which a rivet deforming means is used to deform the rivets. During a rivet deforming operation the rivet deforming means applies force directly onto a rivet engaging pin to cause it to withdraw from a rivet. Thus the pin must be sufficiently strong to withstand the force, and accordingly the apparatus is applicable only to tubular revets having a tubular portion of sufficient size to accommodate a rivet engaging pin big enough to withstand the force.

SUMMARY OF THE INVENTION

Thus, it is an object of the present invention to provide a riveting apparatus which is more generally applicable.

Another object of the invention is to provide an apparatus in which the rivet engaging means are not directly subject to the force of a riveting operation.

The invention relates to riveting apparatus for tubular rivets. The apparatus has a structure which receives rivets fed to it from for instance a hopper via a raceway. The structure is for instance a spring-loaded gate. Spaced from the gate is a hammer for deforming rivets. Means are provided for picking up rivets from the gate. A conveyer carries the rivet pick-up means to convey rivets from the gate to a position at which they can be deformed by the hammer, and back.

The rivet pick-up means comprise a pin for engaging within a tubular rivet and a support supporting the pin. The support is displaceably mounted on the conveyer in such a way that the pin can be moved into an engagement position in which it can engage with a rivet at the gate from an inoperative position. The support is releasably coupled by a releasable latch to for instance a spring or some other resilient device for urging the support in a direction to move the pin into the engagement position. The latch is releasable by the application of a force to it.

It is characteristic of the invention that the force is applied to the latch on a force transmission path which by-passes the rivet engaging pin in order to avoid damaging the pin. Two alternative ways of doing this are described herein.

For one way, there is provided an anvil mounted on the conveyer for movement of the anvil from and towards the support. The anvil defines a throughbore through which the rivet engaging means projects when urged into the engagement position. The anvil is mounted on a resilient support for resiliently urging it away from the support from the pin. The arrangement is such that when the hammer is moved into contact with a rivet supported on the anvil, and in which rivet the pin is engaged, the impact is transferred via the rivet and anvil to the support and thence to the latch which is released. The support moves taking the pin with it into the inoperative position.

It will be appreciated that in such an embodiment the force transmission path is implemented by an arrangement requiring force transmission from the deforming means through the rivet. Thus, in such a case and where the context requires, the term "a rivet" should be construed as including only rivets suitable for the purpose of transmitting a force adequate for operating such an arrangement.

For the other way, there is provided an engagement member which is movable into engagement with the support. There is also provided means, such as a cam for example, which is coupled to the hammer to move with it. The cam is arranged to engage with the engagement member at latest by the time the hammer has touched but not substantially deformed a rivet on the pin, to displace the engagement member into engagement with the support to transmit impact of the cam on the engagement member to the latch to release it whereupon the support moves taking the pin into the inoperative position.

Means are provided for displacing the spring in a direction to re-engage the coupling between the support and the spring. These means are for instance a cam. The cam is arranged to displace the spring as the rivet engaging pin (and its support) are conveyed back to the gate from which rivets are picked up. The cam also so holds the spring reconnected to the support that the rivet engaging means is held in the inoperative position until it is conveyed back to the first station.

According to one embodiment of the invention, the rivet engaging means is removable for replacement by alternative rivet engaging means for engaging within a different size of tubular rivet.

The riveting apparatus may also or alternatively be constructed so as to be adaptable to vary the number and/or relative positions of the rivets engageable by the rivet engaging means.

BRIEF DESCRIPTION OF THE DRAWINGS

For a better understanding of the invention and to show how the same may be carried into effect, reference will now be made by way of example to the accompanying drawings, in which.

DETAILED DESCRIPTION OF THE INVENTION

Firstly an embodiment of the apparatus shown in FIGS. 1, 2, 5, 6, 7 and 8 will be described.

Figure 1:
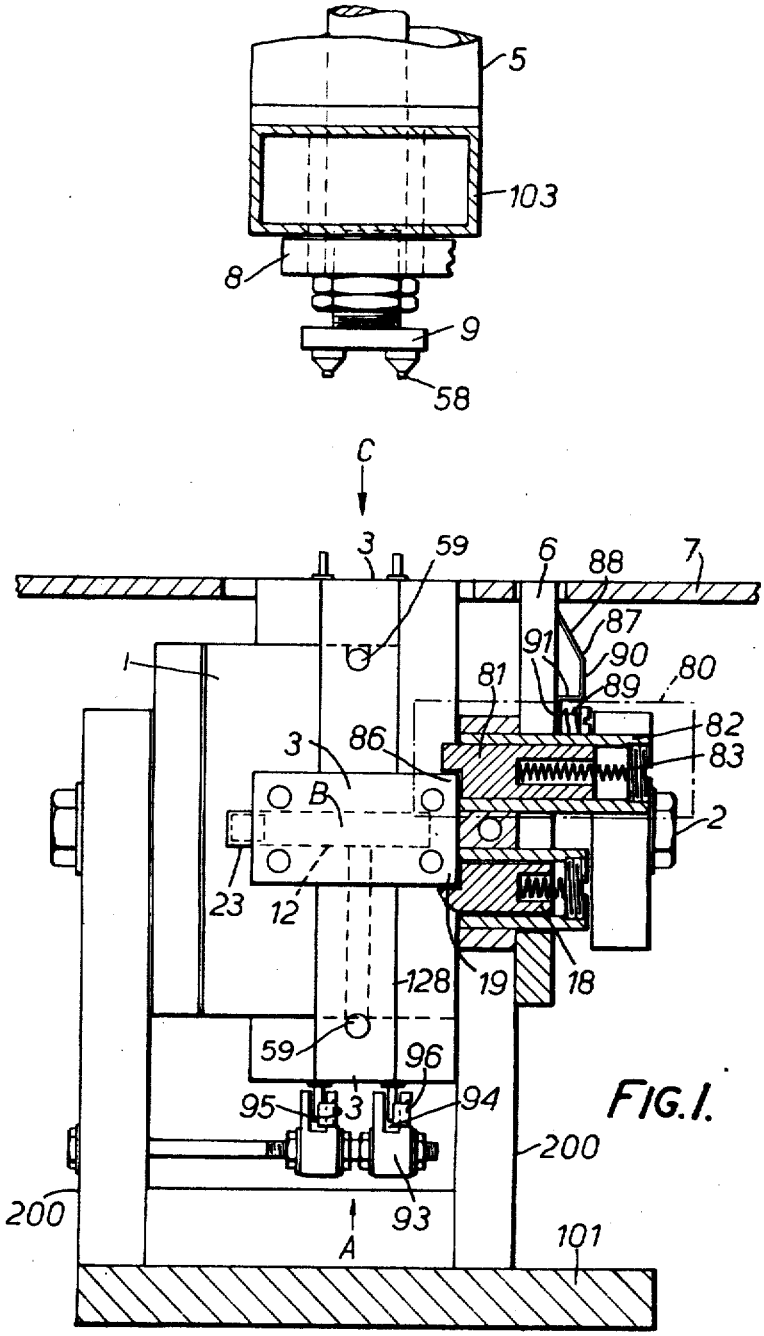
FIG. 1 shows a rear elevational view of riveting apparatus in accordance with the invention, the apparatus having a rotor.
Figure 2:
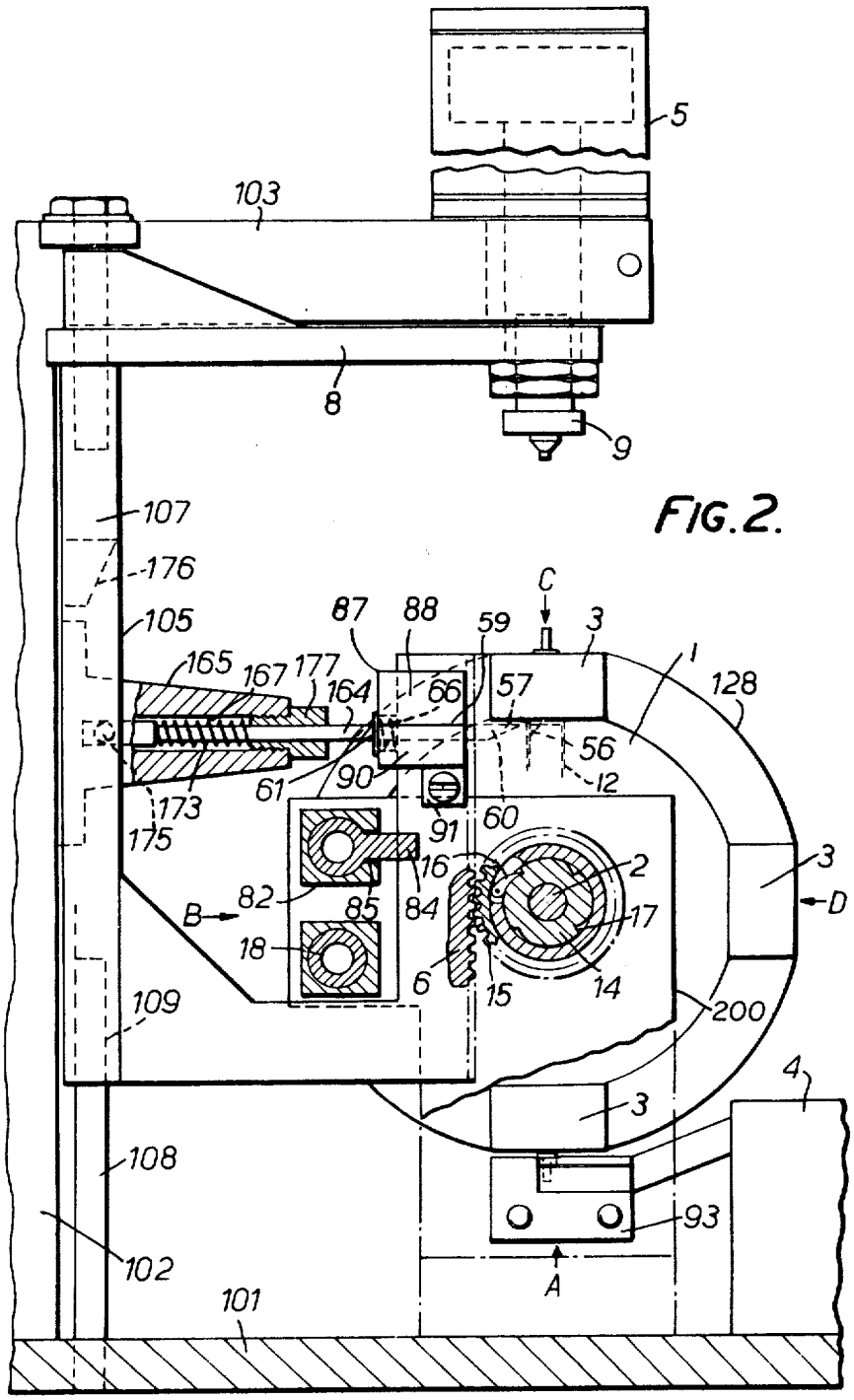
FIG. 2 shows a side elevational view of the embodiment of the apparatus of FIG. 1 partly in section to reveal details of the structure of the apparatus.

Referring to FIGS. 1 and 2, the shown embodiment of the riveting apparatus comprises a disc-like arrangement, hereinafter termed "the rotor", supported for free rotary movement about the axis of a horizontal shaft 2. The rotor 1 is supported by a support structure comprising a base 101 from which upstands an upright member 102, which may be of box-section. A cross member 103 also of box-section extends from the upper end of the upright member 102, the cross member 103 supporting a double-acting pneumatic ram 5.

Slidably mounted in the support structure is a frame 105 which carries a crossbar 8 supporting a hammer 9, and a rack 6. The frame 105 is coupled to the double-acting pneumatic ram 5 for simultaneous displacement of the rack and hammer.

The frame 105 is slidably mounted on guides 108 which slidably engage in a bore 109 in an upright tubular portion 107 of the frame. The guides 108 extend adjacent to and parallel to the upright member 102 of the support structure. The shaft 2 of the rotor 1 is supported by further upright, rotor support members 200 which upstand from the base 101.

The rotor carries four rivet pick-up means, hereinafter referred to as assemblies 3 for holding tubular rivets, which assemblies will be described in detail hereinafter. The assemblies 3 are spaced apart through 90° relative to each other. The apparatus also comprises a rivet feeding mechanism 4 (shown only in FIG. 2 for clarity) arranged to feed tubular rivets to a station A. The double-acting pneumatic ram 5 and rack 6 are coupled to the rotor to impart a step-by-step rotational movement to the rotor. The hammer 9 is arranged to deform rivets at a station C. A working surface 7 (shown only in FIG. 1 for clarity) is provided at station C for supporting a workpiece. The rotor acts as a means for conveying the rivet pick-up means from station A to station C and back.

In operation of the apparatus as assembly 3 picks up a pair or rivets, in a manner described hereinafter, from the mechanism 4 at station A. The rotor 1 is then rotated so that the assembly moves to an intermediate location B, which is an idle position, and then to the station C. At station C a workpiece may be placed onto the rivets, the rivets protruding through holes in the workpiece. The rotor 1 is held against rotational movement (in a manner described hereinafter) as the rack 6 descends and the hammer 9 strikes the rivets to deform them and thus attach them to the workpiece. The rotor is then rotated through a further 90° so that the assembly moves to a further intermediate location D and is then moved again to return the assembly to station A to pick up further rivets. The means for achieving these operations will now be described.

A ratchet plate 14 shown only in FIG. 2 for the sake of clarity is fixedly connected to the rotor 1 for rotation therewith. The plate 14 is generally circular and has four shoulders 17 against which a pawl 16 fixed to a toothed annular member 15 can abut. The annular member 15 engages with the rack 6 and is rotatable relative to the rotor 1 so that, considering the orientation of the apparatus shown in FIG. 2, as the rack 6 descends the rotor 1 does not rotate therewith. When the rack 6 ascends the pawl 16, constituted for example by a leaf spring, engages with one of the shoulders 17 of the ratchet plate 14 and thus causes the rotor 1 to rotate with the member 15 through 90°.

The spacings of the shoulders 17 are such in relation to the stroke of the rack 6 that only after the rack 6 has ascended for a short distance to allow the hammer to be clear of a workpiece, does the rotor rotate, thereby to allow removal of the workpiece before the rotor moves. Means are provided for positively preventing the rotor 1 from reverse rotation, i.e. anti-clockwise as shown in FIG. 2, during the descent of the rack 6. Such means may for example comprise a spring-loaded stop 18 adapted to co-operate successively with four projections on the rotor: in this case the projections are provided by respective shoulders 19 of the four assemblies 3. The arrangement is such that during each desired rotation of the rotor on ascent of the rack 6, one of the projections will, as the rack reaches the limit of its upward movement, move past the stop 18 which will immediately snap into an operative position on the path of said projection thereby positively to limit reverse angular movement of the rotor. There is also provided means 80 for preventing undesired forward, i.e. clockwise, rotational movement of the rotor. Such forward movement may be caused for example by the pawl 16 frictionally coupling with the ratchet plate 14 as the rack 6 ascends, before it engages with one of the shoulders.

There will now be described with reference to FIGS. 7, 8*a* to 8*e* and also to FIGS. 5 and 6 the rotor of the apparatus shown in FIGS. 1 and 2. The assemblies 3 are arranged in respective slots 12 which are defined by two grooved annuli 122*a* and *b* best shown in FIGS. 8*b* to 8*e*. Referring to FIG. 7 or 8*b* the annuli are spaced relative to one another by a tube 120. The tube and annuli are arranged coaxially of the shaft 2, about the axis of which the rotor 1 is rotatable.

Referring to FIGS. 8*b* to 8*e* each annulus 122 has four radially extending grooves 12 arranged 90° apart, a circular recess 124 for accommodating an end of the tube 120, a bore through which the shaft 2 extends, and a circular recess 126 for accommodating a shaft bearing 125 (as shown in FIG. 7).

The two grooved annuli are arranged on the shaft such that the respective grooves of one annulus face and are aligned with, the respective grooves of the other annulus to define the respective slots in which respective slide blocks 22 of the assemblies 3 are arranged. The arrangement of the annuli 122 and the tube 120 is such that assemblies 3 can be replaced by assemblies having a different length, the difference in length being taken up by replacing tube 120 with another tube of a length corresponding to that of the replacement assemblies.

Each assembly 3 comprises an anvil 20 arranged at the periphery of the rotor, the anvil being rigidly secured by means of bolts extending therethrough and into the annuli over the ends of its slot 12. Each assembly further comprises a slide block 22 releasably connected to a cam follower 23 by means of a latching means 33. The slide block is provided with bearings 54, for reducing friction between the block and the wall of the slot 12. The slide block 22 has two radially extending bores 28 lying side-by-side in a plane parallel to, and through the axis of, the shaft 2. The bores respectively contain springs 29 for urging rivet engaging means in the form of pins 21 radially outwardly. The slide block constitutes a supporting means for the pins. The pins 21 extend into guide bores 31 in the anvil 20, the pins being long enough to extend so far as to project radially outwardly from the anvil to facilitate picking up and holding rivets in place on the anvil. Radially inwardly of the bottom of the bores 28 is a transverse bore 32 containing the means 33 for releasably connecting the slide block 22 to the cam follower 23.

Figure 5:
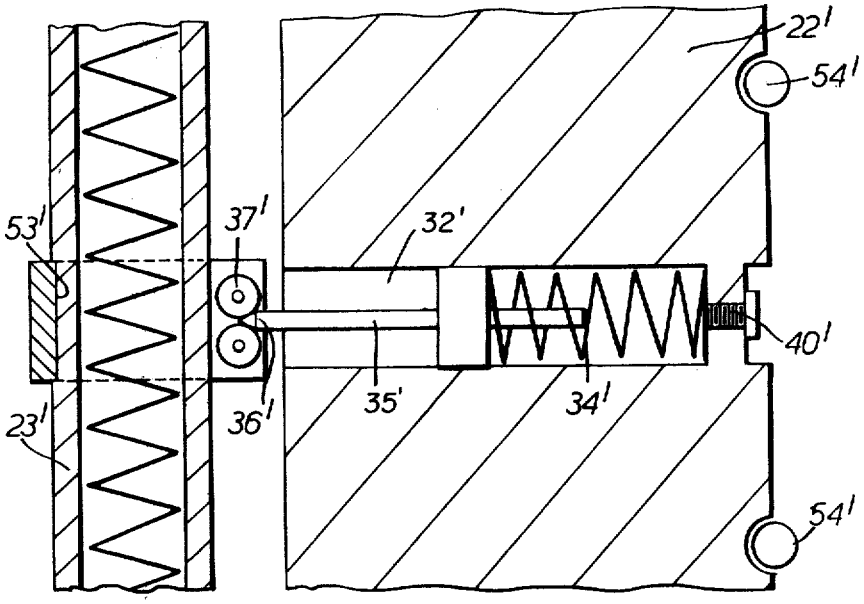
FIG. 5 shows a side elevational view of details common to the rotor of FIG. 3 and of the rotor of FIG. 1.
Figure 6:
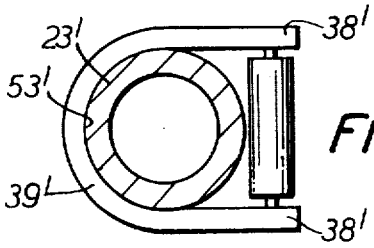
FIG. 6 shows in plan view, a detail of FIG. 5.
Figure 7:
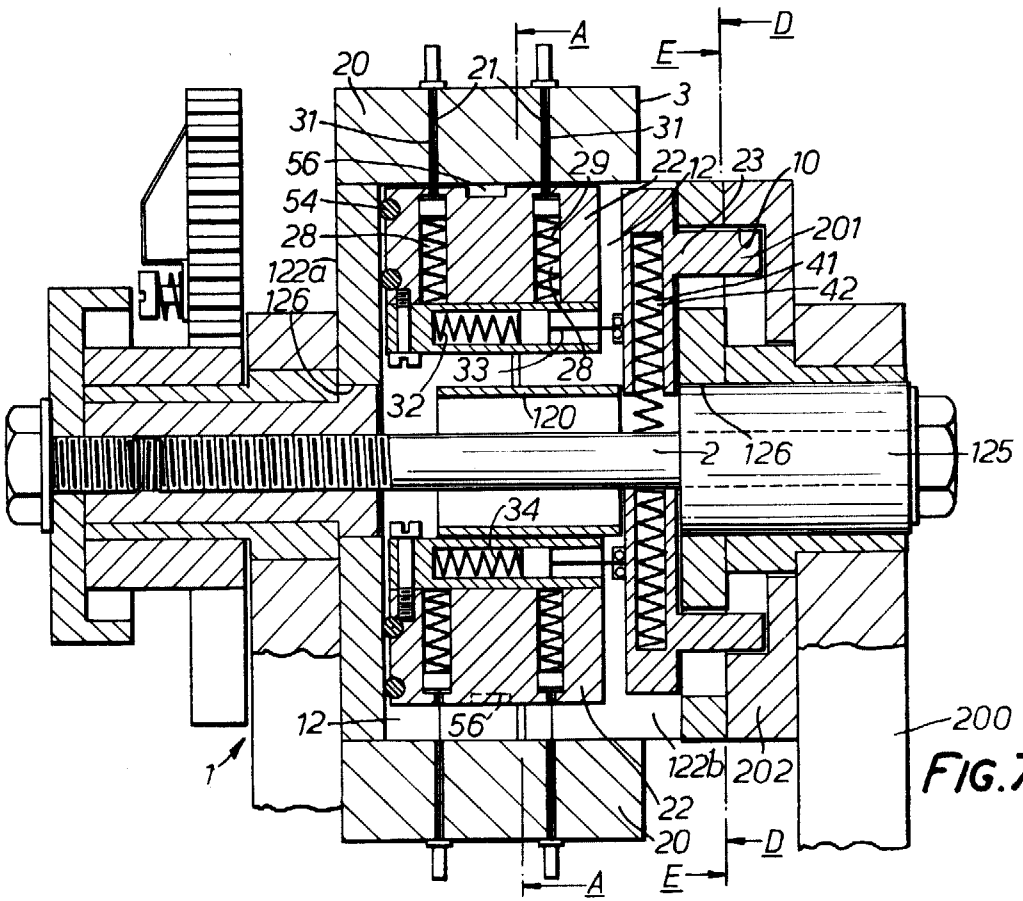
FIG. 7 shows in section the rotor of the riveting apparatus of FIGS. 1 and 2 as viewed in front elevational view of the apparatus shown in FIG. 1.

The latching means 33 is shown in greater detail in FIGS. 5 and 6 in which the various parts of, and associated with, the connecting means are indicated by the same reference numerals as in FIG. 7, but which reference numerals have primes. It comprises a plate-like member 35' slidable in the bore 32', and a spring 34' for urging the member 35' towards the cam follower 23'. The flat major surfaces of the member 35' lie in planes perpendicular to the longitudinal axis of the cam follower and the axis of the bore 32'. The end of the member 35' nearest the cam follower is pointed for engaging between two rollers 37' arranged at the cam follower 23'. The rollers are held between flanges 38' of a member 39' held in an annular recess 53' of the cam follower 23'. A grub screw 40' is provided for adjusting the spring force which urges the member 35' towards the cam follower.

Figure 8A:
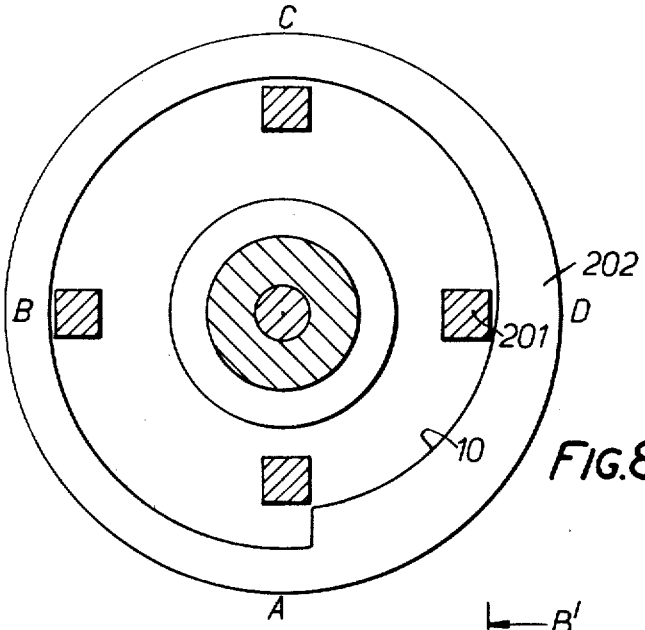
FIG. 8*a* shows a section on line E—E of FIG. 7.
Figure 8B:
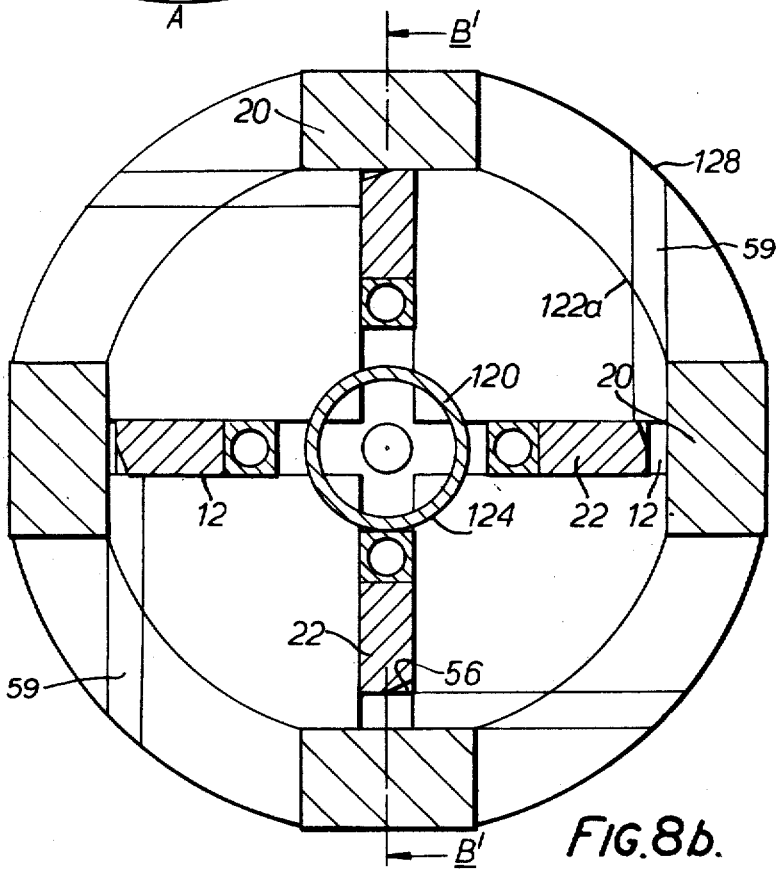
FIG. 8*b* shows a section of line A—A of FIG. 7.
Figure 8C:
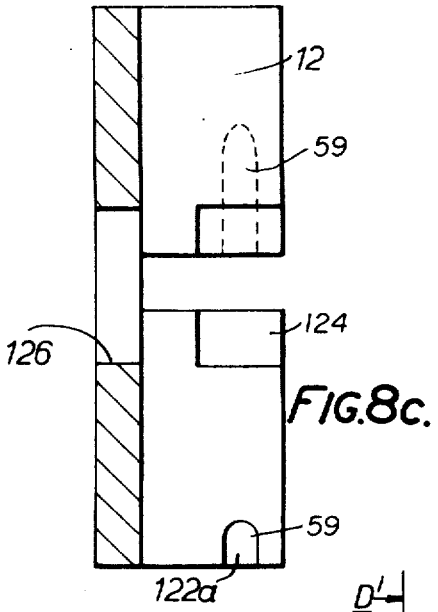
FIG. 8*c* shows a section of a member of the rotor on line B'—B' of FIG. 8*b*.
Figure 8E:
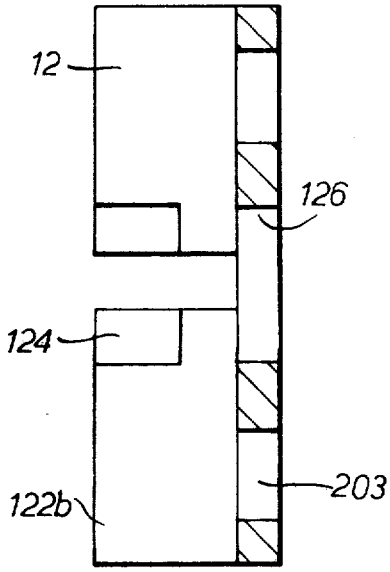
FIG. 8*e* shows a section of the another member of the rotor on line D'—D' of FIG. 8*d*.
Figure 8D:
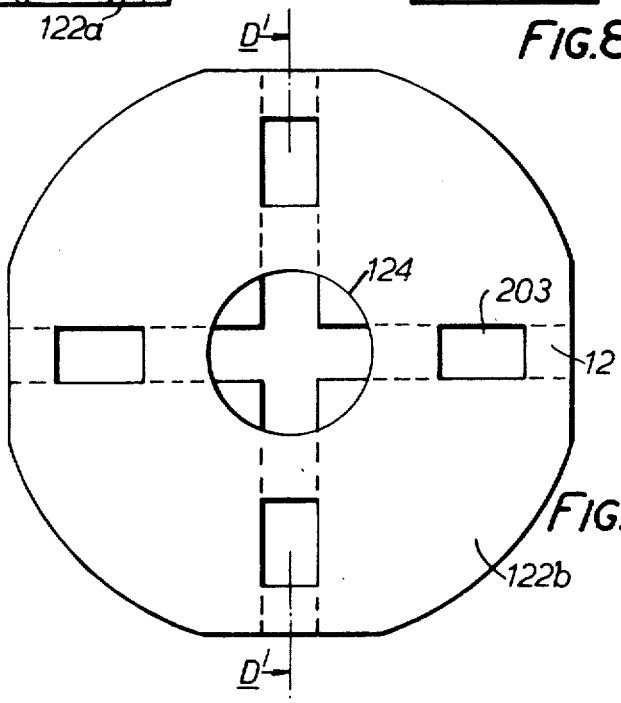
FIG. 8*d* shows another member of the rotor as viewed in the direction indicated by section line D—D of FIG. 7.
Figure 9A:
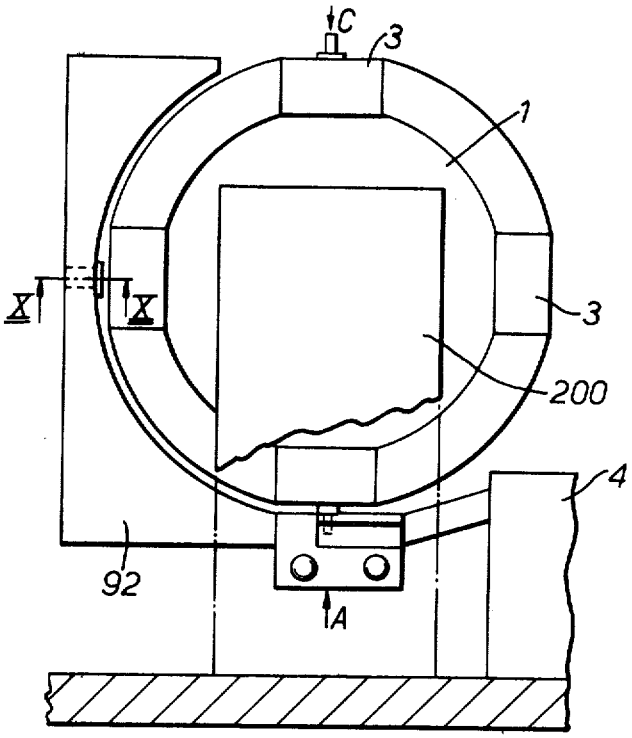
FIG. 9*a* shows a portion of the apparatus of FIG. 2 (many parts shown in FIG. 2 being missing from FIG. 9*a* for the sake of clarity) together with an arcuate guide.
Figure 9B:
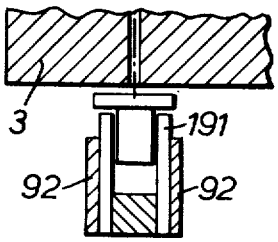
FIG. 9*b* shows a section on line X—X of FIG. 9*a*.

Referring again to FIG. 7, the cam follower 23 is loaded with a spring 41 for urging it radially outwards. The spring is disposed at least partly in a bore 42 in the cam follower. The cam follower is arranged to engage with a camming surface 10 on a stationary cam 202, the follower having for this purpose a projection 201 which projects through a slot 203 in annulus **122*b* (FIGS. 8*d* and *e*). As shown in FIG. 8*a*, the cam 202 is so shaped that the radial distance from the shaft 2 to the camming surface 10 of the cam is greater at station C than at station A so that between stations C and A the spring 41 is increasingly compressed. The camming surface 10** has a shoulder at station A but is otherwise continuous.

Because the anvils project radially outwardly of the annuli there are spaces between them which are filled by covers 128 (FIGS. 1, 2 and **8*b***) which may be of rubber or plastics.

Referring now to FIGS. 1 and 2, a force coupling means for coupling the slide blocks when at the second station to the deforming means is provided for disconnecting the respective slide blocks from the cam followers to cause the pins to withdraw from the rivets at station C at least by a time when the deforming means has already contacted the rivets but has not substantially deformed the rivets so as to be able to avoid permanent deformation of the pins.

The force-coupling means comprises elongate cylindrical engagement members 60 for engaging with respective ones of the assemblies 3, the members 60 being accommodated in respective bores 49 defined in the covers 128 and the annuli, the bores extending perpendicularly to the axis of the shaft 2 and respectively perpendicularly to the radially extending portions 12 of the slots defined in the rotor. Each bore 59 intersects its associated slot at or near the radially outer end of the slot.

Each of the slide blocks 22 has a recess 56 provided at or near its radially outer end.

The engagement members 60 are slidably arranged in the respective bores 59, each member 60 terminating in a tongue 57. The members 60 are so positioned that the respective tongues 57 can engage with the recesses 56 so as to displace the slide blocks in the slots by wedge-action. Each member 60 has retained around it between a shoulder 66 of the bore and a flange 61 attached to the member 60 a compression spring for urging the tongue 57 away from the recess 56.

The force-coupling means further comprises a housing 165 fixed to the upright member 102. The housing defines a bore 167 accommodating a displacing member 164, the housing 165 being so positioned relative to the rotor that the displacing member 164 can engage with members 60 one at a time. There is provided in the bore 167 a spring 173 retained between a shoulder on the member 164 and an annular guide member 177 for the member 164. The spring 173 biases the member 164 away from the rotor. Extending from the displacing member 164 is a peg 175 which also extends through a slot (not shown) in the housing 165. Provided on the upright portion 107 of the frame 105 is a cam 176, the arrangement being such that, in operation of the apparatus, as the hammer descends, and before the hammer contacts a rivet at location C, the cam 176 engages with the peg 175 and causes the displacing member to displace an elongate member 60 so that the tongue 57 engages in the recess 56.

The tongue and recess are so shaped that the slide block 22 is thus pushed radially inwards with a sufficient impact to disconnect it from the cam follower 23. The slide block 22 then drops under the influence of gravity. Thus the pins 21 disengage from the rivets prior to their being contacted by the hammer 9.

When the rack 6 ascends the member 164 and the member 60 are urged axially away from the slot 12.

The rivet feeding mechanism 4 is arranged to deliver rivets to station A. The mechanism may comprise an inclined track consisting of three parallel plates defining a pair of inclined channels for delivering the rivets in pairs to station A. The rivets may be automatically fed to the track from a vibratory bowl or container. There may be provided a spring-loaded gate so arranged as to locate a pair of rivets at station A. When a located pair is picked up by an assembly 3' and driven thereby away from station A, rivets are urged through the gate which closes behind those rivets to locate the next pair.

The apparatus described hereinbefore with reference to FIGS. 1, 2, 5, 6, 7 and **8*a* to 8*e* is adapted to operate as follows. Let it be assumed that a pair of rivets has been picked up by an assembly 3** at station A and has been subsequently driven to station C.

In its travel from station A to C, the cam follower 23 is engaged with the slide block 22 by means of the latching means 33. The slide block abuts against the anvil 20 due to the spring force of the cam follower spring 41. The pins 21 project radially outwardly from the anvil holding rivets in place on the anvil. At station C an operator places a workpiece onto the rivets and the rack 6 descends causing the pawl 16 to disengage from a shoulder 17. The rotor is held against reverse rotation by the stop 18 as hereinbefore described. As the rack descends the hammer 9 strikes the rivets. The slide block 22 is forced radially inwards by the wedge-action of the tongue 57 engaging with recess 56. The member 35 disengages from the rollers 37 and so the slide block disengages from the cam follower 23. Consequently, the slide block 22 drops rapidly onto the tube 120 and the pins withdraw from the rivets. The hammer is arranged to produce flanges on the rivets to fix them to the workpiece. The slide block disengages from the cam follower before the hammer hits the ends of the pins. The depth of the slot 12 to the radially outer surface of the tube 120 is arranged to be sufficient for the pins not to extend radially outwardly from the anvil when the slide block 22 is in its radially innermost position.

After the hammer has hit the rivets the rack 6 ascends, and after the rack has ascended for a short distance as described hereinbefore, pawl 16 engages with one of the shoulders 17 to drive the assembly through another 90° from the station C to location D. During this rotation, the cam follower, which is disengaged from the slide block is engaged with the camming surface 10 of the cam 202 and as the rotor rotates, spring 41 is compressed and the cam follower is urged radially inwards by the camming surface 10. The cam follower re-engages with the slide block in the vicinity of location D.

During the interval after the rivets have been deformed and before the next pair of rivets are delivered to station C, the workpiece is removed.

At station A there is the shoulder of the cam 202 so that the cam follower abruptly moves radially outwards under the influence of the spring 41, taking the slide block with it. The resiliently mounted pins 21 are accordingly pushed into the bores in rivets waiting at station A. The springs 29 act to stop the pins from being damaged in case they do not initially engage with the bores of the rivets. They also act to allow the pins a small degree of movement to help the pins locate in the rivet bores.

In the embodiments shown in FIGS. 1 and 2, the means 80 for preventing undesired forward movement are provided adjacent location B and ensure alignment of the respective assemblies 3 with the hammer 9 for rivet deforming operations. The means 80 comprises a stop member 81 slidable in a housing 82 and biased towards the rotor by a spring 83. Fixed to, and extending transversely of the member 81, is a peg 84 (shown only in FIG. 2) which extends through a slot 85 in the housing 82. The slot and peg define the extent of movement of the member 81.

Provided at each of the assemblies 3 is a shoulder 86 with which the stop member can engage when an assembly is at location B.

A release member 87 is provided for releasing the stop member 81 from engagement with a shoulder 86. The release member 87 is fixed to move with the rack 6 and comprises a ramped portion 88 extending to a portion 90 spaced from and extending parallel to the rack, the portion 88 being arranged to engage with the peg, and pushing the stop member 81 away from the rotor as the rack 6 rises. The release member terminates at its end most remote from the hammer 9 in an L-shaped flange 91. A portion of the flange is urged against the rack 6 by means of a coil spring 89.

Part of the 'L'-shaped flange 91 is cut away to allow the peg 84 to pass between the rack and the release member as the rack descends, the arrangement being such that a coil spring 89 allows the release member 87 to move away from the rack as the peg 84 passes between the rack and the ramp portion.

The apparatus, and in particular the alignment means 80 and release member 87, is adapted to operate in the following manner. Let it be assumed that a rivet deforming operation has just been carried out and the rack has started to rise. The ramp portion 88 engages with the peg 84 before the pawl 16 engages with a shoulder 17 of the ratchet plate 14 to allow a workpiece to be removed from the apparatus before the rotor rotates. The member 81 is pushed out of engagement with a shoulder 86 and the rotor rotates, the peg 84 riding on the release means as the release means passes. As soon as the release means has passed the member 81 moves towards the rotor to the fullest extend of movement defined by the peg 84 and slot 85, so that it can engage the next following shoulder 86.

As the rack 6 descends the peg passes through the cutaway part of flange 91 and between the release means and the rack. The peg engages with the ramp portion of the release member and displaces the release member outwards against the force of the coil spring and so passes underneath the release member.

There is shown in FIGS. 1 and 2 an example of the spring-loaded gate for locating a rivet at station A. It is to be appreciated that a plurality of such gates may be provided for locating a respective plurality of rivets at station A. The arrangement shown in FIGS. 1 and 2 is for a rotor for riveting two rivets at a time, there being two gates. Each gate shown in FIGS. 1 and 2 is for locating only one rivet at a time. Each gate comprises a block 93 defining a channel 94 extending tangentially to the direction or rotation of the rotor. A slot 95 for allowing a leaf spring 96 to engage with a rivet is provided in one of the walls defining the channel. The leaf spring is elongate and fixed to the outer side of the one of the walls. It has an arcuate end portion for engaging about a portion of the tubular portion of a rivet.

It is desirable to provide an arcuate guide (not shown) between stations A and C to prevent rivets from disengaging from the pins by being thrown outwardly by centrifugal force during rotational movement of the rotor. The guide may comprise two plates spaced apart parallel to each other. The plates are so spaced that the flanges of the tubular rivets slide on the edges of the plates with their tubular portion extending between the plates. Preferably as shown in FIGS. **9*a* and 9*b* the guide may further comprise rubber sheets 191 on which the rivets can ride. The sheets are supported by the plates 92.** The arrangement is such that the tubular portions of the rivets extend between the sheets, the flanges riding on the edge of the sheets. When the apparatus is adapted to pick up a plurality of rivets at a time a plurality of guides as described above are required.

Alternatively, there may be provided as shown in FIGS. **9*c* and 9*d* a curved pipe 93 having a plurality of openings 94, the pipe being arranged in an arc between stations A and C. The pipe is supplied with exhaust gas from the ram 5, the gas being directed by the openings at the path along which the rivets will travel on the pins 21** between stations A and C, the rivets being held onto the pins by the flow of exhaust gas over them.

There will now be described with reference to FIG. 3 a rotor which differs from the embodiment of the rotor 1 shown in FIGS. 1, 2, 7 and 8. It is to be appreciated that either the rotor of FIG. 7 or the rotor of FIG. 3 could be used in the apparatus. Details of the rotor of FIG. 3 are also shown in FIGS. 4, 5, 6 and 10.

Figure 3:
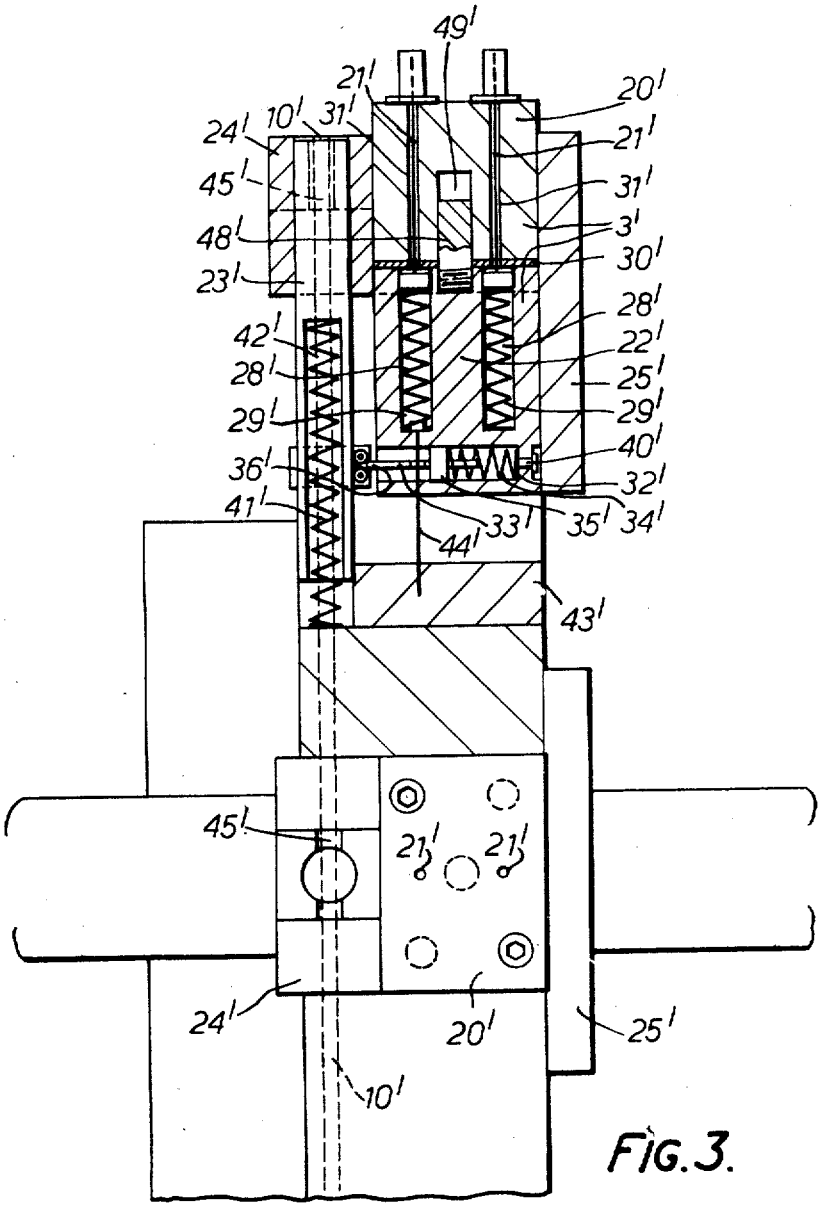
FIG. 3 is a part-sectional view on an enlarged scale of a rotor which may be used in place of the rotor of the apparatus of FIGS. 1 and 2 illustrating the construction of a rivet pick-up means.
Figure 4:
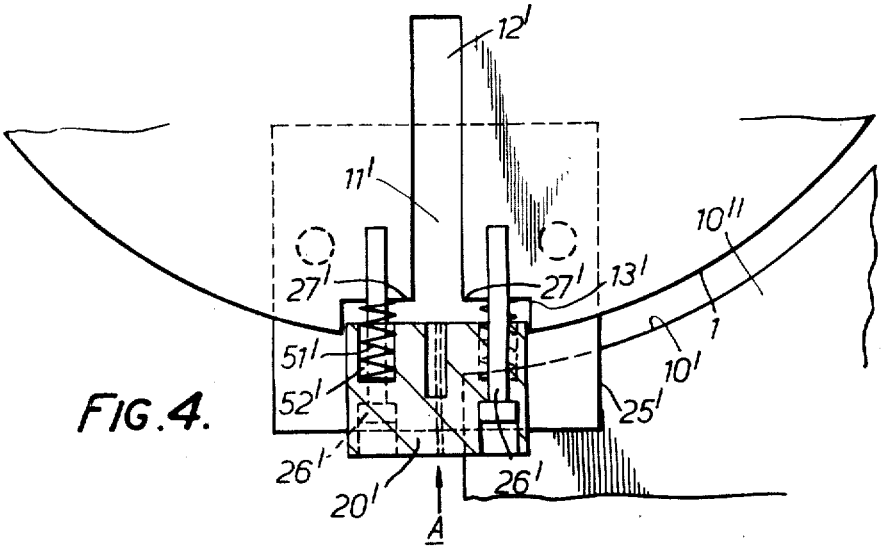
FIG. 4 shows a sectional view of a portion of the rotor of FIG. 3.

The embodiment shown in FIGS. 3 and 4 of the rotor comprises a disc-like member, there being four "T"-shaped slots 11' extending through the entire thickness of the rotor, and spaced apart through 90° relative to each other. Referring to FIG. 4, each slot comprises a first radially extending rectangular portion 12' and a second portion 13' at the periphery of the rotor and extending perpendicularly to the first. Assemblies 3' are disposed in the respective T-shaped slots 11'. Referring to FIGS. 3 and 4, each assembly comprises an anvil 20' disposed in slot portion 13', and a slide block 22' releasably connected to a cam follower 23', both the block and cam follower being disposed in the slot portion 12'. The cam follower is retained in the slot and guided for radial movement, by a member 24' disposed in the slot portion 13'. There is a plate 25', fixedly connected to the rotor, covering a portion of the slot for retaining the slide block 22' in the slot. The slide block 22' may be provided with roller bearings 54' (shown in FIG. 5 but not in FIG. 3) for reducing friction between the block and the walls of the slot portion 12'.

The anvil 20' is radially movable in the slot portion 13', the extent of its radial movement being defined by the shoulders 27' defining the mouth of the slot portion 12' and the abutment of the anvil with the heads of set screws 26' which retain it in the portion 13'. The anvil is provided with springs 51' for urging it radially outwards. The springs are contained in bores 52'.

As considered in the orientation shown in FIG. 3, which shows the assembly as it is from station A to station C, the slide block 22' has two radially extending bores 28' lying side-by-side in a plane parallel to, and through the axis of, the shaft. The bores respectively contain springs 29' for urging pins 21' radially outwardly. The heads of the pins are retained in the bores by a plate 30'. The slide block constitues a support for the pins. A projection 48' is provided for locating the slide block relative to the anvil. The projection engages in a bore 49' in the anvil. The pins 21' extend into guide bores 31' in the anvil 20', the pins being long enough to extend so far as to project radially outwardly from the anvil to facilitate picking up and holding rivets in place on the anvil. Radially inwardly of the bottom of the bores 28' is a transverse bore 32' containing latching means 33' for releasably connecting the slide block 22' to the cam follower 23'.

As also shown in FIG. 5, the latching means 33' comprises a plate-like member 35' slidable in the bore 32', and a spring 34' for urging the member 35' towards the cam follower 23'. The flat major surfaces of the member 35' lies in planes perpendicular to the longitudinal axis of the cam follower and axis of the bore 33'. The end of the member 35' nearest the cam follower is pointed for engaging between two rollers 37' arranged at the cam follower 23'. As shown in FIG. 6, the rollers are held between flanges 38' of a member 39' held in an annular recess 53' of the cam follower 23'. A grub screw 40' is provided for adjusting the spring force which urges the member 35' towards the cam follower. A pin 44' (FIG. 3) retains the member 35' in the bore 32', there being an axially extending slot in the member 35' through which the pin extends for allowing axial movement of the member 35'. Also disposed at the radially innermost portion, i.e. the bottom, of each slot is a block 43' into which the pin 44' extends.

Figure 10:
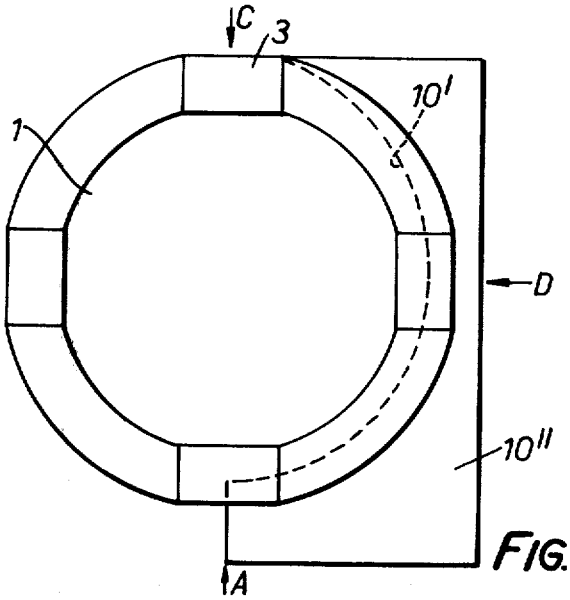
FIG. 10 shows in side elevation, the rotor of FIGS. 3 and 4 and the cam plate of that rotor.
Figure 9C:
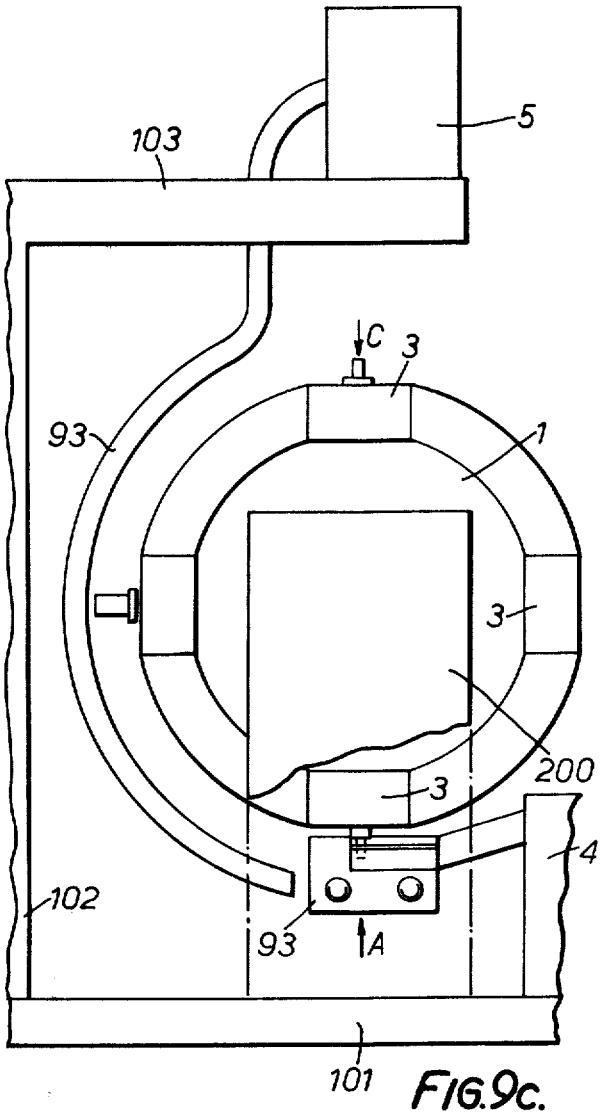
FIG. 9*c* shows a portion of the apparatus of FIG. 2 (many parts shown in FIG. 2 being missing from FIG. 9*c* for the sake of clarity) together with an apertured pipe.
Figure 9D:
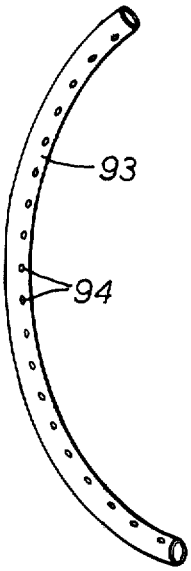
FIG. 9*d* shows a portion of the apertured pipe.

The cam follower 23' is provided with a spring 41' for urging it radially outwards. The spring is disposed partly in a bore 42' in the cam follower. The cam follower is arranged to engage with a camming surface, in this case a lateral edge of a plate 10'' shown in part in FIG. 4 and more completely in FIG. 10, a guide member 24' being provided with a groove 45' at its radially outermost portion, in which groove cam plate 10'' rides. The embodiment of the rotor shown in FIGS. 1 and 2 does not have such a cam plate 10''. It will be seen, however, that the rotor shown in FIGS. 7 and 8 has a camming surface (10 in FIGS. 7 and 8*a*) arranged in a way similar to surface 10' of cam plate 10'' described here. The cam plate 10'' is as best shown in FIG. 10 so arranged that the radial distance from the shaft 2 to the camming surface 10' of the cam plate is greater at station C than at location D so that between station C and location D the spring 41' is increasingly compressed. From location D to station A this radial distance is substantially constant. The camming surface ends abruptly at station A as shown in FIG. 4.

The rivet feeding mechanism 4 is arranged to deliver rivets to station A. The mechanism may comprise an inclined track consisting of three parallel plates defining a pair of inclined channels for delivering the rivets in pairs to station A. The rivets may be automatically fed to the track from a vibratory bowl or container. There may be provided a spring-loaded gate so arranged as to locate a pair of rivets at station A. When a located pair is picked up by an assembly 3' and driven thereby away from station A, rivets are urged through the gate which closes behind those rivets to locate the next pair.

The apparatus described hereinbefore is adapted to operate as follows. Let it be assumed that a pair or rivets has been picked up by an assembly 3' at station A and has been subsequently driven to station C.

In its travel from stations A to C, the assembly is as shown in FIG. 3. The cam follower 23' is engaged with the slide block 22' by means of the latching means 33'. The slide block abuts against the anvil 20', which is substantially at the greatest extent of its outward radial movement, due to the spring force of the cam follower spring 41'. The pins 21' project radially outwardly from the anvil holding rivets in place on the anvil. At station C an operator places a workpiece onto the rivets and the rack 6 descends causing the pawl 16 to disengage from a shoulder 17. The rotor is held against reverse rotation by the stop 18 as hereinbefore described. As the rack descends the hammer 9 strikes the rivets. The anvil 20' and slide block 22' are forced radially inwards by the impact of the hammer. The plate-like member 35 rides over the lower of the rollers 37' pushing back against spring 36 and so the slide block disengages from the cam follower 23'. Consequently, the slide block 22' drops rapidly onto the block 43' to withdraw the pins, and the anvil drops onto the shoulders of the slot portion 13'. The hammer is arranged to produce flanges on the rivets to fix them to the workpiece.

The assembly is so arranged in relation to the particular rivets which it is arranged to hold that the slide block disengages from the cam follower before the hammer hits the ends of the pins. The depth of the slot portion 12' to the radially outer surface of the block 43' is arranged to be sufficient for the pins not to extend radially outwardly from the anvil when the slide block 22' is in its radially innermost position, and the depth of the slot portion 13' is arranged to allow sufficient radially inward movement of the anvil for the slide block to be disengaged from the cam follower as a result of the hammer blow.

After the hammer has hit the rivets the rack 6 ascends, and after the rack has ascended for a short distance as hereinbefore described pawl 16 engages with one of the shoulders 17 to drive the assembly through another 90° from the station C to location D. During this rotation, the cam follower, which is disengaged from the slide block engages with the camming surface 10' of the cam plate. As the rotor rotates, spring 41 is compressed and cam follower is urged radially inwards by the camming surface. The cam follower re-engages with the slide block in the vicinity of location D.

During the interval after the rivets have been deformed and before the next pair of rivets are delivered the workpiece is removed.

At station A the cam plate abruptly ends so that the cam follower abruptly disengages from the cam plate and moves radially outwards due to the release of the spring 41', taking the slide block engaged with the cam follower with it. The resiliently mounted pins 21' are accordingly pushed into the bores in rivets waiting at station A. The springs 29' act to stop the pins from being damaged in case they do not initially engage with the bores of the rivets. They also allow the pins a small degree of movement to help the pins locate in the rivet bores.

When the rivets have been picked up the cycle described is repeated.

It is to be appreciated that various assemblies 3 or 3' can be interchangeably used in the slots in the rotors of FIGS. 3 and 7 in order to facilitate use of different sized rivets, different numbers of rivets, and different spacing of rivets.

The dimensions of the anvil 20 or 20', pins 21 or 21', slide block 22 or 22' and block 43 or tube 120 of each assembly are arranged in dependence upon the size and arrangement of rivets to be used.

It is also to be appreciated that the anvil, slide block and pins can be arranged to feed rivets into a workpiece in configuration other than that shown in Figures wherein the pins lie side-by-side in a plane parallel to the axis of the shaft. The pins may, for example, lie side-by-side in a plane extending at an angle to the axis of the shaft.

In addition to the interchangeability of the assemblies, the position of hammer 9 is adjustable. It is possible to alter both the spacing of the hammer on the crossbar 8 from the rack 6, and also the spacing of the crossbar from an end of the rack. The hammer comprises a tip having rivet striking members 58 and is removable from the crossbar 8 so that it can be replaced by another hammer having a different configuration of striking members 58.

It is to be appreciated that embodiments of the rotor may comprise more than four assemblies, for instance six or eight assemblies equally spaced on the rotor. In that case the angle of rotation of the rotor between each riveting operation will be made shorter. Embodiments may also comprise a plurality of rotors arranged on a single shaft, or with their respective shafts arranged coaxially. The respective rotors may also be arranged to use different sizes or types of rivets. Thus a multiplicity of rivets may be fixed to a workpiece in one operation.

Alternatively, the rotor may be adjustable to accommodate assemblies having different numbers of pins for engaging with rivets.

It is also to be appreciated that the apparatus is suitable for many different sizes and types of rivets. For very small rivets, the pins 21 may for example comprise nylon filaments. However, pins 21 can alternatively be provided to accommodate rivets of for example ¼ inch bore.

It is to be appreciated that any suitable means other than the means described, can be used for imparting a step-by-step rotation of the rotor. For instance, it may be feasible to use an arrangement comprising a sprocket and chain, or a foot-operated pedal connected to impart the intermittent movement of the rack 6 could be used. It is also to be appreciated that there could be provided a drive means for just the hammer in addition to the drive means for the rack.

An embodiment of the apparatus may be so constructed as to include a rotor and rivet feeding mechanism as described in U.S. Pat. No. 3,101,858. Thus this embodiment could be used to carry out alternative riveting operations.

I claim:

1. A riveting apparatus for tubular rivets, the apparatus comprising a rivet receiving and supporting structure at a first station of the apparatus, rivet deforming means at a second station of the apparatus for applying a force to deform a rivet, means for picking-up rivets from said structure, and conveying means for conveying the rivet pick-up means from the first station to the second station and back, the rivet pick-up means comprising:

means for engaging within a tubular rivet;

means for supporting the rivet engaging means, the supporting means being displaceably mounted for moving the rivet engaging means from an inoperative position to an engagement position in which it engages within a rivet at the first station;

means for urging the supporting means in a direction to produce said movement of the rivet engaging means to the engagement position; and latching means for releasably coupling the urging means to the supporting means, the latching means being releasable by the application of force to the latching means;

the apparatus further comprising force coupling means for coupling the supporting means when at the second station to the deforming means to transmit a force via the supporting means and by-passing the rivet engaging means to the latching means to release the coupling between the urging means and supporting means to allow the rivet engaging means to withdraw from a tubular rivet into the inoperative position, and displacing and holding means for displacing the urging means in a direction to recouple the coupling between the urging means and the supporting means as the rivet engaging means is conveyed from the second station back to the first station, and for holding the urging means and supporting means so that the rivet engaging means is held in the inoperative position until it is conveyed back to the first station.

2. Apparatus as recited in claim 1, wherein the force coupling means comprises an anvil mounted on the conveying means for movement of the anvil away from and towards the supporting means, the anvil defining a throughbore through which the rivet engaging means projects when urged into said engagement position, and a resilient support arrangement for resiliently urging the anvil away from the supporting means; whereby when the deforming means operates rivet deforming force is transmitted via the anvil, by-passing the rivet engaging means, to the supporting means to release the coupling between the supporting means and urging means.

3. Apparatus as recited in claim 2, wherein the conveying means defines a slot, one direction of extent of which is in the direction of movement of the rivet engaging means from the inoperative position to the engagement position, the anvil being positioned over the mouth of the slot, and the supporting means being accommodated in the slot.

4. Apparatus as recited in claim 2, wherein the supporting means defines an open-ended bore, and wherein the latching means comprises a first latch member connected to urging means, a second latch member displaceable in the bore, and a spring in the bore for urging the second latch member in the direction out of the bore and towards the first latch member for engagement with the first latch member.

5. Apparatus as recited in claim 2, wherein the displacing and holding means comprises a member defining a camming surface, and a cam follower coupled to the urging means so as to be urged in a direction to engage with the camming surface.

6. Apparatus as recited in claim 2, comprising a resilient mounting resiliently connecting the rivet engaging means to the supporting means.

7. Apparatus as recited in claim 6, wherein the supporting means defines a bore receiving the rivet engaging means, and the resilient mounting comprises a spring in the bore.

8. Apparatus as recited in claim 1, wherein the force coupling means comprises:

a movable engagement member for engaging with the supporting means for transmitting to the supporting means a force to release the latching means; and means for moving with the deforming means, and for so coupling with the engagement member at a predetermined position of the deforming means to displace the engagement member into engagement with the supporting means so as to produce an impact which releases the latching means.

9. Apparatus as recited in claim 8, wherein the movable engagement member engages with the supporting means in wedge-fashion.

10. Apparatus as recited in claim 9, comprising a displaceable structure coupled to the deforming means to move therewith, the structure carrying a cam for displacing the engagement member by wedge action to produce said impact.

11. Apparatus as recitied in claim 8, wherein the supporting means defines an open-ended bore, and wherein the latching means comprises a first latch member connected to urging means, a second latch member displaceable in the bore, and a spring in the bore for urging the second latch member in the direction out of the bore and towards the first latch member for engagement with the first latch member.

12. Apparatus as recited in claim 8, wherein the displacing and holding means comprises a member defining a camming surface, and a cam follower coupled to the urging means so as to be urged in a direction to engage with the camming surface.

13. Apparatus as recited in claim 8, comprising a resilient mounting resiliently connecting the rivet engaging means to the supporting means.

14. Apparatus as recited in claim 8, wherein the supporting means defines a bore receiving the rivet engaging means, and the resilient mounting comprises a spring in the bore.

15. Apparatus as recited in claim 8, wherein the rivet pick-up means comprises an anvil for supporting a rivet, when engaged by the rivet engagement means, the anvil defining a throughbore through which the rivet engaging means projects when urged into said engagement position.

16. Apparatus as recited in claim 15, wherein the anvil is fixed relative to the conveying means.

17. Apparatus as recited in claim 15, wherein the conveying means defines a slot, one direction of extent of which is in the direction of movement of the rivet engaging means from the inoperative position to the engagement position, the anvil being positioned over the mouth of the slot, and the supporting means being accommodated in the slot.

18. Apparatus as recited in claim 1, comprising means for positioning the rivet pick-up means in a predetermined position relative to the second station so that the deforming means can locate accurately with a rivet at the second station.

19. Apparatus as recited in claim 18, comprising a support structure for the apparatus, the positioning means comprising an abutment surface on the conveying means, a stop member displaceably supported on the support structure for displacement into engagement with the abutment surface, and means coupled to move with the deforming means for disengaging the stop member from the abutment surface in dependence upon the position of the deforming means relative to the conveying means.

20. Apparatus as recited in claim 1, wherein the conveying means comprises:

a first end member defining a groove;

a second end member defining a groove; and a spacer holding the end members relative to one another so that the grooves of the end members are aligned so as to define a slot having a direction of extent in the direction of displacement of the rivet engaging means from the inoperative position to the engagement position;

the slot accommodating the supporting means, urging means and latching means.

21. Apparatus as recited in claim 1, comprising an apparatus support structure including a shaft on which the conveying means is arranged, the conveying means being rotatable on the shaft for conveying the rivet pick-up means from the first station to the second station and back, and drive means for intermittently rotating the conveying means.

22. Apparatus as recited in claim 21, and comprising a displaceable structure coupled to the shaft by means for converting displacement of the structure into rotation of the conveying means on the shaft, the drive means being coupled to the deforming means for displacing the deforming means together with the conveying means.

23. Apparatus as recited in claim 22, wherein the converting means comprises a ratchet and pawl mechanism coupling the conveying means to the displaceable structure.

24. Apparatus as recited in claim 22, comprising means for preventing reverse rotation of the conveying means, which preventing means are arranged on the apparatus support structure for engaging with the conveying means.

* * * * *